US008282704B2

(12) United States Patent
Poulalion

(10) Patent No.: US 8,282,704 B2
(45) Date of Patent: Oct. 9, 2012

(54) METHOD AND INSTALLATION FOR INTRODUCING A CORED WIRE INTO A BATH OF MOLTEN METAL

(75) Inventor: Andre Poulalion, Valenciennes (FR)

(73) Assignee: Affival, Solesmes (FR)

( * ) Notice: Subject to any disclaimer, the term of this patent is extended or adjusted under 35 U.S.C. 154(b) by 172 days.

(21) Appl. No.: 12/444,052

(22) PCT Filed: Oct. 3, 2007

(86) PCT No.: PCT/FR2007/052072

§ 371 (c)(1),
(2), (4) Date: Apr. 2, 2009

(87) PCT Pub. No.: WO2008/040915

PCT Pub. Date: Apr. 10, 2008

(65) Prior Publication Data

US 2010/0005927 A1 Jan. 14, 2010

(30) Foreign Application Priority Data

Oct. 3, 2006 (FR) ..... 06 54072

(51) Int. Cl.
*C22B 9/10* (2006.01)

(52) U.S. Cl. ..... 75/526; 75/414

(58) Field of Classification Search ..... 75/526, 75/414

See application file for complete search history.

(56) References Cited

U.S. PATENT DOCUMENTS

| | | | | |
|---|---|---|---|---|
| 3,729,309 | A * | 4/1973 | Kawawa | 420/126 |
| 4,738,714 | A * | 4/1988 | De Zeeuw | 228/127 |
| 2005/0274773 | A1 * | 12/2005 | Poulalion | 228/101 |

FOREIGN PATENT DOCUMENTS

| | | |
|---|---|---|
| DE | 196 00 608 | 5/1997 |
| DE | 100 65 914 | 6/2002 |
| JP | 60-52507 | 3/1985 |

OTHER PUBLICATIONS

Mario Grigoletto et al., "Gleichbleibende metallurgische Qualitat bei der Magnesium-behandlung von Gusseisen", Giesserei, Dec. 1, 1997, vol. 84, No. 23, pp. 54-56.

Norbert Bannenberg et al., "Aufschmelzverhalten von Fulldrahten wahrend des Einspulens", Stahl Und Eisen, Dec. 14, 1992, vol. 112, No. 12, pp. 101-107.

* cited by examiner

*Primary Examiner* — George Wyszomierski
*Assistant Examiner* — Tima M McGuthry Banks
(74) *Attorney, Agent, or Firm* — Young & Thompson

(57) ABSTRACT

A method for introducing a cored wire into a bath of molten metal includes extracting the cored wire from a reel, and making it run into the molten metal bath, one part of the path traveled by the cored wire being formed in a guide tube with a distal end at a defined height above the metal bath's surface. The cored wire is driven and straightened under conditions practically not altering its substantially circular cross section and allowing it to be vertically introduced and penetrate into the depth of the bath. Elements for driving the cored wire from a reel, a guide tube for guiding the cored wire, and elements for straightening the cored wire are placed in front of its entry into the guide tube, the straightening elements giving the cored wire a straight direction without altering its circular cross section.

11 Claims, 4 Drawing Sheets

METHOD AND INSTALLATION FOR INTRODUCING A CORED WIRE INTO A BATH OF MOLTEN METAL

BACKGROUND OF THE INVENTION

This application is a national stage entry of PCT/FR07/52072 filed 10/03/2007 .

1. Field of the Invention

The present invention concerns the field of metallurgy, and more particularly the adjustment of the composition or the inclusion treatment of a bath of molten metal by the introduction of an additive by means of a cored wire containing said additive.

It concerns more precisely a method and an installation for introducing a cored wire into a bath of molten metal with an improved effective yield of addition of additives.

2. Description of the Related Art

Metals and metal alloys such as steel or cast iron have properties which depend in particular on their composition. The manufacture of metals and metal alloys generally starts from a base composition, the content of certain components of which is adjusted according to the desired final composition.

This adjustment is made according to several techniques, including the introduction into the bath of molten metal of a predetermined length of a cored wire, i.e. of a long element constituted by an outer covering in which the additive which is to be introduced is contained in the form of a powder.

The covering of the cored wire is generally provided by starting from a thin metal sheet or strip, the two opposed longitudinal edges of which are folded back so as to hook onto each other after a tubular configuration has been imparted to said sheet. By means of this mechanical fastening of the two edges, a good seal is obtained with regard to the additive.

The cored wire is produced in the form of a very long reel, for example 6000 metres long. Conventionally, as illustrated schematically in FIG. 1 of the document FR 2.871.477, it is extracted from the reel which is either static, arranged inside a cage, or dynamic, wound on a drum, then it passes on a horizontal path into an injector, which drives it into an elbowed guide tube. The cored wire emerges from the distal end of the guide tube at a defined height above the surface of the bath, of the order of from 1 to 1.4 metres. The injector shown in FIG. 1 of the document FR 2.871.477 is a conventional injector comprising three sets of two cylindrical rolls, driven in rotation, between which the cored wire passes. The pressure exerted by the rolls should be sufficient to permit the extraction of the wire from the reel and the driving of said wire towards the bath, through the guide tube. This pressure generally causes deformation of the wire in cross-section.

It is known that the use of the technique of adjustment of the composition of a bath of molten metal by means of a cored wire may pose problems with certain additives, especially calcium, magnesium, selenium and sulphur. For some, the heat of the bath of molten metal causes the explosion of the cored wire in a zone very close to the surface of the bath. For others, the additive vaporises very rapidly in proximity to the surface. In all cases, a strong surface reaction occurs, generating a certain number of phenomena: oxidation and/or nitriding of the bath, spattering of the liquid metal, strong fumes given off.

With this type of additive, it is found that in order to obtain the adjustment of the composition of the bath in the additive in question, a length of cored wire, and therefore a quantity of additives actually provided by the wire, is required which is much greater than the theoretical length which would have been necessary if all the additive provided had participated in the adjustment of the composition of the bath.

This introduction operation therefore generally has a very low yield, an addition yield which may be of the order of 10 to 15%.

An endeavour has already been made to improve the addition yield, by introducing the cored wire into the bath by passing it inside a protective tube or lance, made of refractory material, previously introduced into the bath. However, the presence of this refractory tube or lance going into the bath has, in addition to its high cost, other drawbacks linked in particular to the risk of clogging of the tube or of the lance and of pollution of the bath as a result of erosion of the tube or of the lance by the bath itself.

It has also been proposed, in order to improve the addition yield, to cover the metal covering in which the additive is located, with a second covering which is combustible but without leaving harmful residues and which momentarily retards the spread of heat towards the core of the cored wire. It consists in particular of one or more strips of paper wound in a spiral round the first metal covering. The paper is selected to have a resistance to ignition and a thermal resistance coefficient which are greater than those of an ordinary sheet of paper.

The presence of this second covering makes it possible to introduce the cored wire to a greater depth and therefore to minimise the effects of explosion and/or vaporisation of the additive.

In order to prevent the second covering from being degraded while being coiled and especially during its extraction from the reel, it is preferable to provide a third, metal covering, of the same type as the first covering.

This improvement to the cored wire, described in the document FR 2.871.477, has already made it possible to provide a significant improvement to the yield of the operation of introducing the cored wire, especially in the case of additives such as calcium, magnesium, selenium and sulphur.

SUMMARY OF THE INVENTION

The aim of the Applicant is to propose an additional improvement which is not linked to a modification of the structure of the cored wire but which takes account of the introduction method and installation.

The method, in a known manner, consists in extracting the cored wire from a reel and making it run into the metal bath, one part of the path traveled by the cored wire being formed in a guide tube, the distal end of which is at a defined height above the surface of the metal bath.

Characteristically, according to the present invention, the cored wire is driven and subjected to a straightening operation under conditions practically not altering its substantially circular cross-section and allowing it to be introduced and penetrate into the depth of the bath in a vertical direction.

In fact, credit is due to the Applicant for having been able to detect the effect, on the yield of the operation of introducing the cored wire, on the one hand of the deformation of the cross-section of the wire caused by the driving systems of the current installations and on the other hand of the natural tendency of the wire, when it penetrates into the bath, to reassume the curved configuration which it possessed in the reel. These two aspects both have as a practical consequence the fact that the cored wire, when it penetrates into the bath of molten metal, does so in a direction which is not straight but which curves towards the surface of the bath, thereby limiting the depth of introduction into the bath. This is added to the fact that in the current installations for injecting wires, the direction of introduction of the cored wire, in particular that of the guide tube, is oblique with respect to the surface of the bath, which only aggravates the phenomenon of the rising up of the wire towards the surface of the bath.

Thus, according to the concept of the present invention, it is a question of providing the conditions which allow the cored wire to penetrate deeply into the bath in a direction which remains as vertical as possible over the whole of its height before its disintegration.

The straightening operation is carried out by passing the cored wire, before its entry into the guide tube, into a plurality of sets of two press rolls. The pressure exerted, the number of sets of press rolls, their respective distance apart, and the configuration of the contact with the cored wire, are determined so as to obtain the desired straightening, i.e. that in the free state the cored wire maintains a straight configuration and does not tend to reassume the curved configuration which it had during its storage in the reel, and so that the straightened cored wire maintains its substantially circular cross-section.

During this operation it is a matter of applying to the surface of the wire stresses which are equally distributed and sufficient to overcome and cancel out the effect of the internal stresses which have been induced during the reeling and unreeling operations.

In an alternative embodiment, the contact faces of the rolls which are in contact with the cored wire are concave.

Preferably, in this case, the radius of curvature of the concave faces of the press rolls is substantially the same as that of the cored wire. Thus, the pressure exerted by the rolls is applied substantially radially on the cored wire so that there is no damaging crushing or deformation of said wire, even with a high pressure. This makes it possible to limit the number of sets of press rolls, for example to two to five sets of two rolls.

It will be understood that optimally the curvature of the concave faces of the press rolls should be strictly the same as that of the cored wire, which would therefore allow total homogeneity of the pressing forces exerted radially on said wire over the whole surface area of contact between the wire and the roll, but would make it necessary to change the rolls according to the diameter of the wire. Nevertheless, it was found that the radius of curvature of the concave faces could be slightly different from that of the cored wire without any harmful crushing or deformation of the wire taking place, while maintaining the proper straightening of the wire.

This is not exclusive however. Satisfactory straightening, without damaging deformation of the cross-section of the cored wire, was obtained by using a larger number of sets of press rolls, for example around fifteen sets, with a more limited pressure per set. In this case, the contact faces may for example be formed by the two oblique walls of a peripheral groove of triangular cross-section. The pressure exerted by each roll is applied to the cored wire along two continuous lines of contact, and not along one contact surface as in the preceding variant. However, owing to the lesser pressure exerted by each set and to the larger number of sets, no harmful deformation of the circular cross-section of the cored wire is observed.

According to an alternative embodiment, the cored wire is held laterally during its passage between the sets of press rolls, in particular by interposed guide tubes. The aim of this particular arrangement is to hold the cored wire so that it remains straight on its path through the whole of the sets of two press rolls.

In an alternative embodiment, the cored wire is driven at the same time as it is straightened, in particular when straightening is obtained by passing between consecutive sets of rolls, some of the rolls then being driven in rotation.

This is not exclusive, the driving of the cored wire being able in particular to be carried out upstream and independently of its straightening. In this case, the straightening operation is carried out under conditions making it possible to rectify the deformation in cross-section of the wire caused by the driving system. This is preferably achieved by means of straightening using rolls having concave faces the radius of curvature of which is substantially the same as that of the non-deformed cored wire.

Another object of the invention is to propose an installation for introducing a cored wire into a bath of molten metal which includes means for making said cored wire run from a reel and a guide tube for the cored wire, the distal end of which is at a defined height H above the surface of the bath.

Characteristically, according to the present invention, the guide tube extends in a vertical direction. In addition, the installation includes straightening means for the cored wire which are disposed before its entry into the guide tube and are capable of imparting the straight vertical direction to the cored wire practically without altering its substantially circular cross-section.

Preferably, the straightening means are formed by a plurality of sets of two press rolls, the contact between the cored wire and each roll being along a contact surface or along two continuous lines of contact.

In an alternative embodiment, the straightening means are formed by a limited number, for example from three to five, of sets of press rolls of which the faces in contact with the cored wire are concave; preferably the concave contact face of each press roll has a radius of curvature which is substantially the same as that of the cored wire.

Advantageously, in this case, each contact face of each roll corresponds to an angular portion of between 120° and 180°. It will be understood that in theory the angular portion of 180° makes it possible to obtain the radial distribution of the pressing forces over the whole of the outer periphery of a reference wire having a radius which corresponds strictly to the radius of curvature of the press rolls. The angular portion comprised in the range between 120° and 180° makes it possible however to straighten wires having a diameter greater than the reference wire without harmful crushing or deformation.

In an alternative embodiment, the straightening means are formed by a large number, for example from twelve to twenty, of sets of press rolls, in which each roll has a peripheral groove of triangular cross-section, delimiting two oblique faces for contact with the cored wire.

Preferably, the installation includes, between each pair of sets of press rolls, an interposed guide tube, suitable for holding the wire laterally during its movement between the sets of press rolls in a straight direction.

According to an alternative embodiment, the ratio between the inside diameter of the guide tube, and optionally of the interposed tubes, and the diameter of the cored wire is of the order of 1.5 to 5. The guide tube should permit the free movement of the cored wire while nonetheless constraining it to maintain a straight vertical direction. This function is performed for the aforesaid range by the same guide tube for the customary range of diameter of cored wire.

According to an alternative embodiment, the distal end of the guide tube is provided with a protective end-piece more heat-resistant than said guide tube. The purpose of using the protective end-piece is to prevent alteration of the distal end of the guide tube due to the heat of the bath of molten metal and also due to spattering.

The protective end-piece may extend beyond the distal end of the guide tube for a given distance, for example of the order of 10 to 30 cm.

Preferably, the guide tube is in at least two parts, i.e. on the one hand a proximal part and on the other hand a distal part equipped with the protective end-piece, the two said parts being firmly connectable by detachable connecting means, in particular by a screw thread or a bayonet system, so as to permit the replacement of the distal part of the tube and of the protective end-piece.

In an alternative embodiment, the straightening means for the cored wire serve as driving means.

According to one embodiment of the variant, in which the straightening means are formed by a limited number of sets of two press rolls, each set comprises a driven roll and an idle roll. In addition, the idle roll is mounted on a pivoting arm, forming a rocker arm, movable by means of a jack.

In another alternative embodiment, the straightening means are dissociated from the driving means, the latter consisting of an injector disposed upstream of the straightening means. In this case, the cored wire, in the straightening means, necessarily extends in a vertical direction. In addition, it is advisable for the straightening means to be capable of rectifying the deformation caused to the wire, in cross-section, by the straightening means.

BRIEF DESCRIPTION OF THE DRAWING FIGURES

The present invention will become clearer from the following description of the introduction of a cored wire into a bath of molten metal by the use of an installation of which the preferred embodiment is illustrated by the appended drawings, in which.

DETAILED DESCRIPTION OF THE INVENTION

The installation 1 is intended for introducing a cored wire 2 into a bath 3 of molten metal in order to adjust the composition of the bath or to treat the latter with a component or additive, which is contained in the form of a powder inside the cored wire 2.

Figure 3:
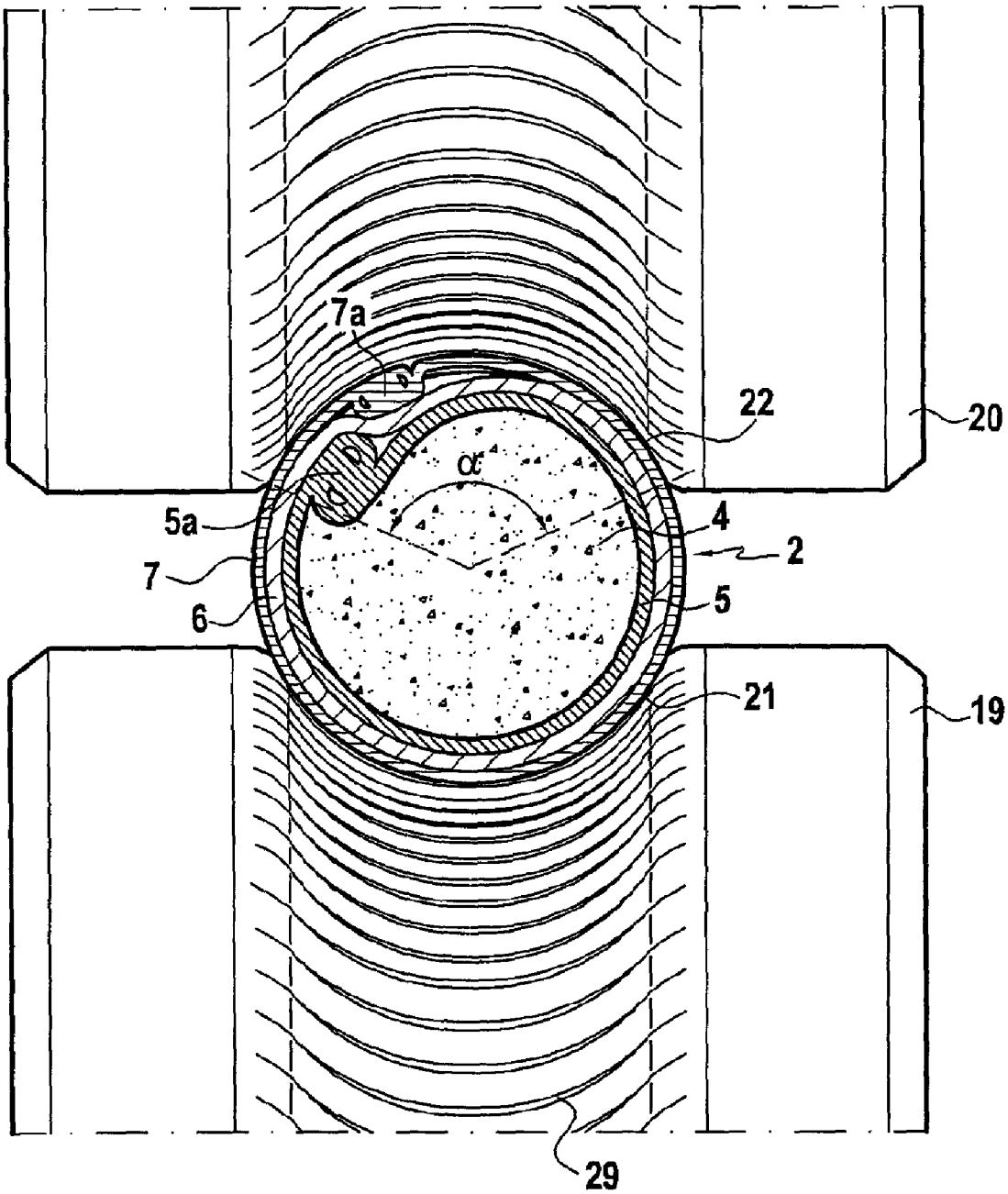
FIG. 3 is a schematic, partial sectional view of two press rolls acting on the cored wire.

In the example illustrated in FIG. 3, the cored wire 2 has a structure which conforms to that described in the document FR 2.871.477. More precisely, the additive 4, in the form of a powder, is housed inside a first metal sheath 5, which is surrounded by a covering 6 which is itself surrounded by a second metal sheath 7. In cross-section, as shown in FIG. 3, the cored wire 2 has a generally circular configuration, the intermediate covering 6 being sandwiched between the two metal sheaths 5 and 7. Each of the two metal sheaths 5, 7 is made from a strip, the two opposed longitudinal edges of which are folded back so as to hook onto each other after a substantially tubular configuration has been imparted to the strip. These fastening zones are shown schematically in FIG. 3 under the reference numbers 5*a* and 7*a*, being turned towards the inside of the tubular wire 2.

The interposed covering 6 is made of a material which is combustible but without leaving harmful residues 10 in the bath of molten metal and which momentarily retards the spread of heat towards the core of the cored wire 2. In a precise exemplary embodiment, the interposed covering is formed by a plurality of strips of paper wound in a spiral around the first metal sheath 5, it being a paper of pyrotechnic type, having a resistance to ignition and a thermal resistance coefficient greater than those of ordinary paper. Even if the structure described above of the cored wire 2 is preferred, it is not however exclusive of the present invention.

The cored wire 2 is fed in from a platform 8 supporting two reels 9, 9' on which are coiled long, continuous lengths of cored wire 2, for example of the order of 6000 linear metres. The second reel 9' serves as a reserve for feeding in wire at the end of the first reel 9.

In the embodiment illustrated, each reel 9 is held statically inside a cage 10. During the extraction of the cored wire, the reel 9 remains fixed, the cored wire 2 being extracted from the core of the reel. This mode of presentation of the cored wire 2 has the advantage, compared with conventional winding on a drum, of not requiring rotation of the reel during unreeling. On the other hand, it has the major drawback, which the present invention is able to remedy, i.e. of considerably increasing the capacity for deformation of the cored wire in the free state, which deformation prevents the straight penetration of said wire into the bath of molten metal.

The installation 1 comprises in succession on the path traveled by the cored wire 2 a guide assembly 11, a driving and straightening assembly 12, a guide tube 13 and a protective end-piece 14. The function of the guide assembly 11 is to accompany the cored wire 2 drawn from the reel 9 during its transfer as far as the entry to the driving/straightening assembly 12. The guide assembly 11 comprises a certain number of rolls 15 which are mounted to be free in rotation, each on a horizontal axis and on which the cored wire 2 rests. The rolls 15 are mounted on a frame 16 generally in the shape of an inverted U, with two elbows, of which the upstream end 16*a* and downstream end 16*b* respectively extend in a substantially vertical direction. The cored wire 2, drawn from the reel 9, is introduced into the upstream end 11*a* of the guide assembly 11, is supported by the rolls 15 and prevented from leaving the guide assembly 11 owing to the configuration thereof in the shape of a cage, with arches 17 fixed to the frame 16 at and/or between the rolls 15.

During its passage in the guide assembly 11, the cored wire is first moved upwards, then substantially horizontally, and finally downwards, extending in a substantially vertical direction on its introduction into the driving/straightening assembly 12 at the outlet of the downstream end lib of said assembly 11.

In the reel 9, the cored wire 2 is wound in the form of substantially adjacent coils. During the extraction of the wire 2 from the core of the reel 9, the wire pulled upwards gradually deforms to change from the coiled configuration to a substantially straight configuration owing to the traction exerted. Nevertheless, this passage generates internal stresses which cause the wire to hold "in memory" its initial coiled configuration, which it reassumes at least in part when the traction exerted on it ceases. These internal stresses are added to those which had been caused during the reeling operation.

The function imparted to the straightening assembly is that of overcoming and cancelling out the effect of all these internal stresses which prevent the cored wire, once introduced into the bath 3, from being able to continue to penetrate in a straight line.

In the embodiment which will now be described, the assembly 12 fulfils both the function of driving the cored wire 2 and the function of straightening said wire. This is not however exclusive, and the driving function may be dissociated from the straightening function; in this case, however, it is preferable for the driving assembly to be disposed upstream of the straightening assembly and for the path traveled by the wire in the straightening assembly to be in a vertical direction with respect to the theoretical plane PP' of the surface of the bath of molten metal 3.

Figure 1:
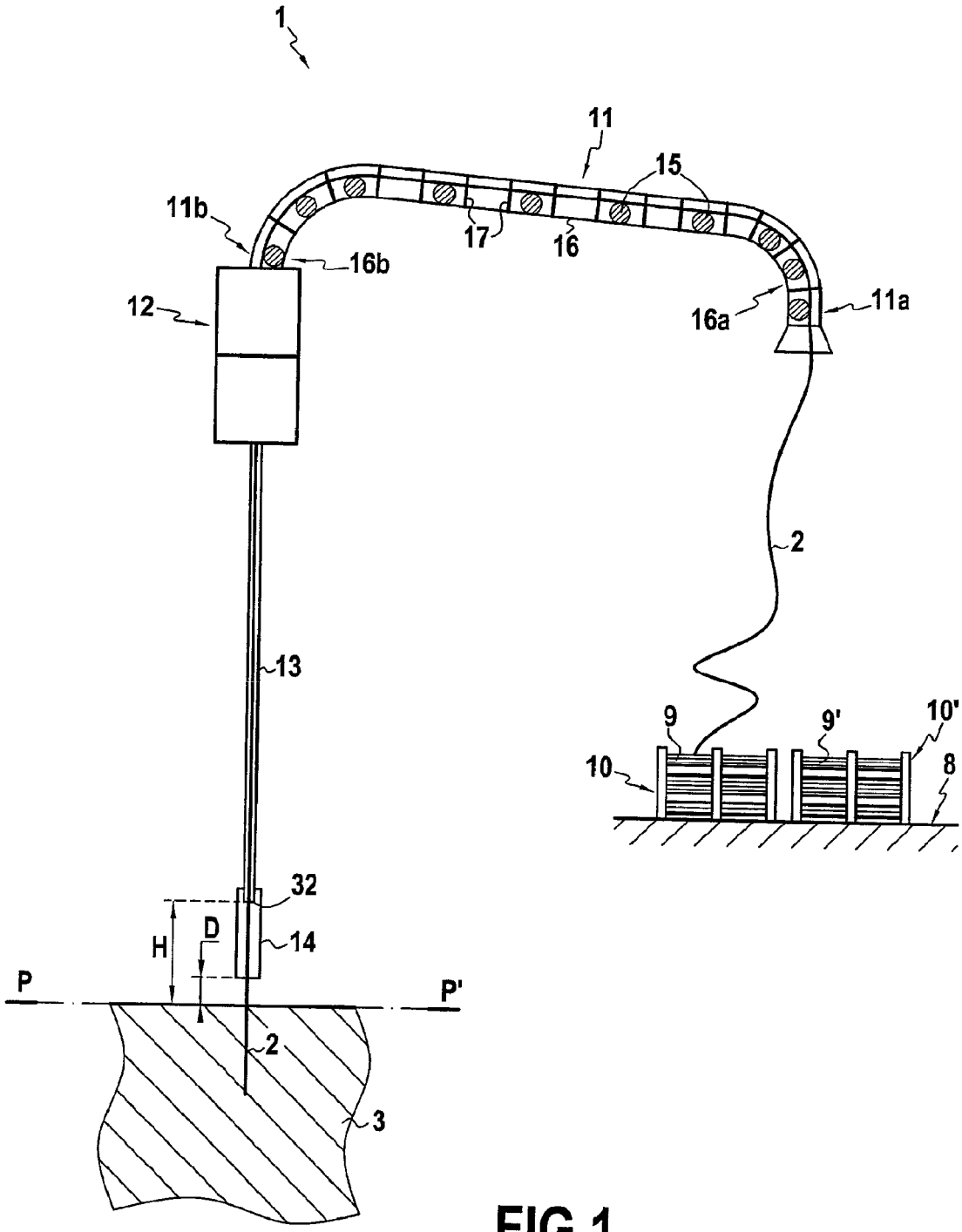
FIG. 1 is a schematic view of said installation, including the path traveled by the cored wire.
Figure 2:
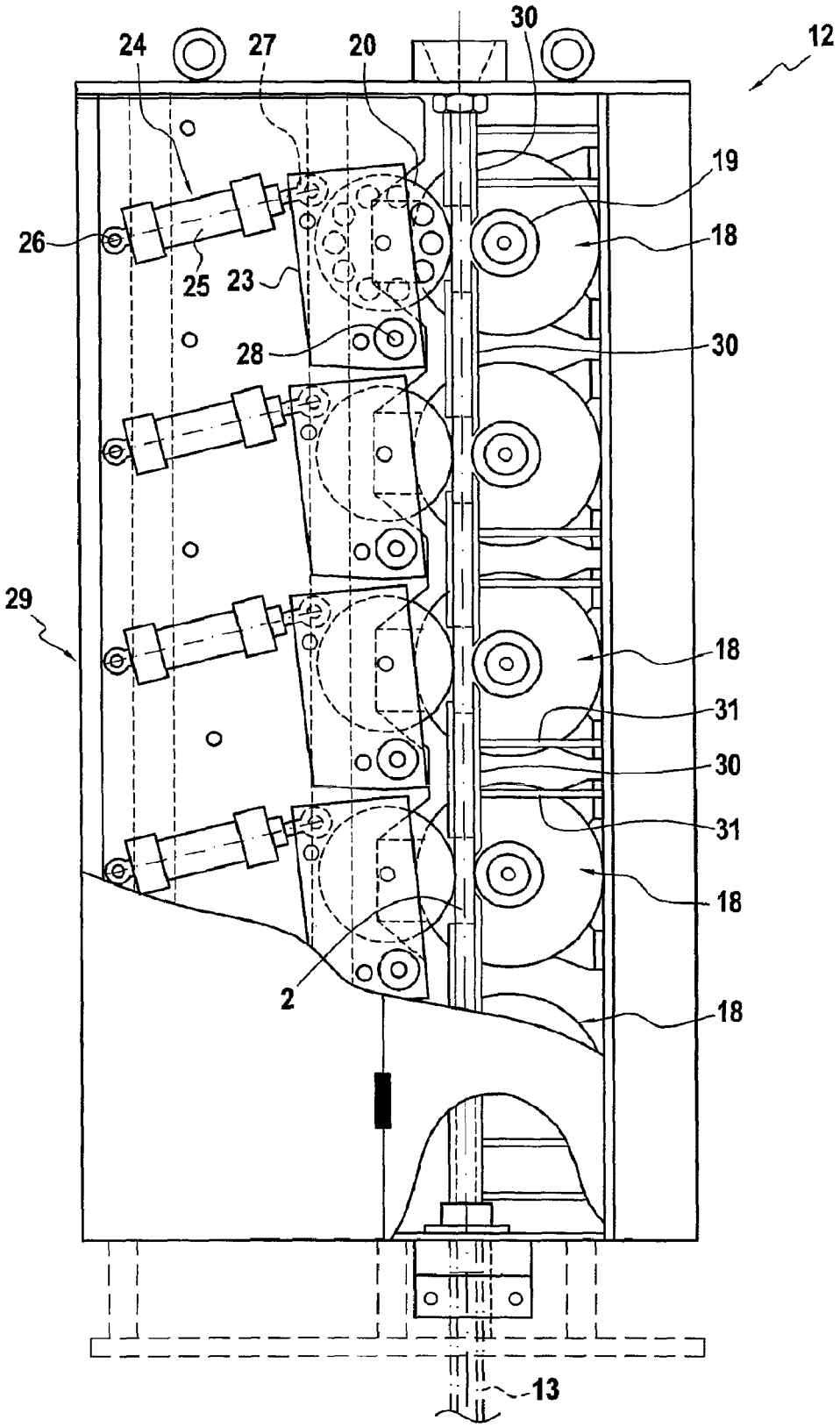
FIG. 2 is a schematic sectional view of a straightening assembly composed of a series of sets of two press rolls.

The driving/straightening assembly 12 which is illustrated in FIG. 2 comprises a series of five sets 18 of two press rolls 19, 20 between which the cored wire 2 passes in a vertical direction. Each roll 19, 20 of each set 18 is in contact with the cored wire 2 on a contact face 21, 22 which is concave. In the example illustrated in FIG. 3, each concave face 21, 22 has approximately the same radius of curvature as that of the outer face of the cored wire 2, i.e. of the second metal sheath 7. As explained previously, the rolls 19, 20 could nevertheless be used for driving and straightening a wire 2 having a radius of curvature less than that of the wire shown.

It is however preferable for each concave face 21, 22 to correspond to an angular portion $\alpha$ of between 120° and 180°, for example 130°, in particular when the driving operation and straightening operation are independent and the straightening means must rectify the deformation caused to the wire during its passage in the driving means.

One of the rolls 19 is driven in rotation, while the other 20 is mounted idle on its axis. The idle roll 20 is mounted on a pivoting arm 23 the pivot axis 28 of which is offset with respect to said idle roll 20. The pivoting arm 23 is moved by a jack 24, the body 25 of which is pivotally fixed on the frame 29 of the assembly 12 and the stem 27 of which is pivotally mounted on the arm 23, opposite to the axis 28 of said arm 23. Thus, owing to the action of the jack 24, it is optionally possible to move the two rolls 19, 20 apart during the introduction of the wire 2, but especially to exert a defined pressure between the two press rolls 19, 20, which pressure is exerted in correlation on the cored wire 2 with a view to straightening it.

Owing to the concave curvature of the contact faces 21, 22, the pressure is applied radially over the whole surface area between said contact faces and the cored wire 2 so that not only does no harmful deformation or flattening occur during the straightening but also there is correction of the deformation or flattening which may exist on the wire, in particular during its passage in independent driving means upstream of the straightening means.

In order to obtain the desired straightening it is necessary, for a given cored wire, to exert a defined pressure overall. Owing to the application of the pressure along a contact surface, it is thus possible to reduce the number of sets of press rolls. A satisfactory result is nevertheless obtained with a larger number of sets of press rolls and the application of the pressure in the form of two continuous lines for each roll, for example with the cored wire coming into contact with the two oblique walls of a peripheral groove of triangular cross-section provided in the roll.

The contact faces 21, 22 may have a certain texture, represented by the curved lines 29 in FIG. 3, so as to increase the coefficient of friction between said faces 21, 22 and the outer face of the cored wire 2, permitting the optimisation of its transfer and also of its straightening.

During its passage between the five sets 18 of press rolls 19, 20, the cored wire 2 assumes a vertical direction. In order, if necessary, to constrain the wire 2 to maintain this direction, in the assembly 12 interposed tubes 30 are provided which extend over the entire height of the assembly 12 in the intervals between the five sets 18 of press rolls 19, 20 and in the inlet and outlet portions of said assembly 12, and through which the cored wire 2 passes.

Each interposed tube 30 is fixed to the frame 29 by cross-members 31. At the outlet of the driving/straightening assembly 12, the cored wire 2 penetrates into the guide tube 13, which is strictly in prolongation of the interposed tubes 30, said guide tube 13 extending in a vertical direction. The function of the guide tube is both to protect the cored wire from the external environment and to maintain the vertical direction of said cored wire during its movement towards the bath 3.

In order to perform this function, the inside diameter of the guide tube 13 is of the order of 1.5 to 5 times the outside diameter of the cored wire 2.

In a precise embodiment, the cored wire 2 had an outside diameter of 11.5 mm and the inside diameter of the guide tube 13 was 36 mm.

Towards the distal end of the guide tube 13, a protective end-piece 14 is provided, intended to protect said end on the one hand from the heat emitted by the bath 3 and on the other hand from the spatter of molten metal which may occur during the introduction of the cored wire 2 into the bath 3. The end-piece is formed of a material more heat-resistant than that from which the guide tube 13 is made, for example of ceramics.

The protective end-piece 14 extends beyond the distal end 32 of the guide tube for a given distance, for example of the order of 10 to 30 cm, so that the protective end-piece 14 can itself be at a relatively short distance D from the surface of the bath 3, for example of the order of from 20 cm to 50 cm.

The purpose of this arrangement is to permit the introduction of the cored wire 2 into the bath 3 while being certain that it maintains its vertical direction, without being altered, before its introduction into the bath, by the heat emitted by the latter. The distance D may of course vary according to the speed at which the cored wire 2 is driven, which speed may be from 40 to 400 metres per minute.

Figure 4:
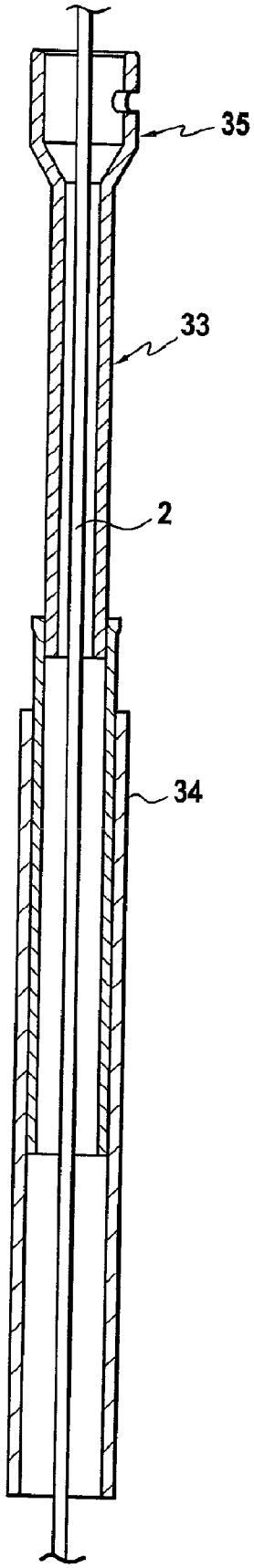
FIG. 4 is a schematic sectional view of the distal portion of the guide tube with its protective end-piece.

A particular embodiment of a protective end-piece 34 is illustrated in FIG. 4. In this embodiment, the guide tube is in two parts, i.e. a proximal part, not shown in FIG. 4, and a distal part 33 onto which is fixed the protective end-piece 34. The distal part 33 may be connected to the proximal part of the guide tube by detachable connecting means, for example a bayonet system 35, only the female part of which is shown in FIG. 4. The advantage of this embodiment of the guide tube in two parts, proximal and distal, is that it is possible to replace only the distal part and the protective end-piece in the event of alteration of these owing to the spattering and the heat emitted by the bath 3.

The invention claimed is:

1. A method for introducing a cored wire (2) into a bath of molten metal (3), comprising:

extracting the cored wire from a reel (9); and making the cored wire run into the bath of metal (3), one part of the path travelled by the cored wire being formed in a guide tube (13), a distal end (32) of which is at a defined height (H) above a surface (PP') of the bath of metal (3), wherein the cored wire (2) is driven and subjected to a straightening operation, under conditions practically not altering a substantially circular cross-section of the cored wire and allowing the cored wire to be introduced and penetrate into a depth of the bath of metal (3) in a vertical direction.

2. The method according to claim 1, wherein the guide tube (13) is disposed vertically above the bath, the straightening operation is carried out by passage of the cored wire (2), before entry of the cored wire into the guide tube (13), through a plurality of sets (18) of two press rolls (19, 20), contact between the cored wire and each press roll being along a contact surface or along at least two lines of contact.

3. The method according to claim 2, wherein the press rolls (19, 20) comprise contact faces (21, 22) with said cored wire (2), the contact faces (21, 22) being concave.

4. The method according to claim 3, wherein the concave contact faces (21, 22) have a radius of curvature, and the radius of curvature of the concave contact faces (21, 22) of the press rolls is substantially the same as that of the cored wire (2).

5. The method according to claim 2, characterized in that the cored wire is held laterally during passage of the cored wire between the sets (18) of press rolls (19, 20) by interposed guide tubes (30).

6. The method according to claim 1, wherein the driving of the cored wire is carried out at the same time as its straightening, some of the press rolls (19) being drive rolls.

7. Method according to claim 1, wherein the driving of the cored wire is carried out upstream and independently of its straightening, and in that during the straightening operation the cored wire (2) extends in a vertical direction.

8. The method according to claim 1, wherein ratio between an inside diameter of the guide tube, and optionally of the interposed tubes, and an outside diameter of the cored wire is of the order of 1.5:1 to 5:1.

9. The method according to claim 1, further comprising:

protecting the distal end (32) of the guide tube (13) on a path beyond said end (32), in proximity to the bath (3), by a protective end-piece (34).

10. The method according to claim 1, wherein the cored wire is extracted from a core of the reel (9).

11. The method according to claim 1, further comprising:

protecting the distal end (32) of the guide tube (13), and the cored wire (2) on its path beyond said end (32), in proximity to the bath (3), by a protective end-piece (34).

* * * * *